US006604256B1

(12) United States Patent
Pytlewski

(10) Patent No.: US 6,604,256 B1
(45) Date of Patent: Aug. 12, 2003

(54) GROUT FLOAT ASSEMBLY

(76) Inventor: Walter W. Pytlewski, 5255 E. Seltice Way, Post Falls, ID (US) 83854

( * ) Notice: Subject to any disclaimer, the term of this patent is extended or adjusted under 35 U.S.C. 154(b) by 299 days.

(21) Appl. No.: 09/630,082

(22) Filed: Aug. 1, 2000

(51) Int. Cl.[7] ..... E01C 19/12; B05C 17/10; B25G 1/00; A47L 13/00

(52) U.S. Cl. ..... 15/235.4; 15/235.6; 15/245.1; 15/143.1; 425/87; 425/458; 81/489; 29/453; 29/458; 29/460

(58) Field of Search ..... 15/235.4, 235.5, 15/235.6, 235.8, 143.1, 245.1; 16/436, DIG. 40, DIG. 41; 81/489; 403/340, 329, 326, 345, 344; 29/446, 450, 453, 458, 460; 425/87, 458

(56) References Cited

U.S. PATENT DOCUMENTS 5,008,970 A * 4/1991 Tsai ..... 15/236.01
5,781,956 A * 7/1998 Kelsay et al. ..... 15/143.1
6,223,384 B1 * 5/2001 Kuhlen ..... 15/235.4

FOREIGN PATENT DOCUMENTS

AU 255137 * 10/1964 ..... 15/235.4

* cited by examiner

*Primary Examiner*—Robert J. Warden, Sr.
*Assistant Examiner*—Laura C Cole
(74) *Attorney, Agent, or Firm*—Robert Louis Finkel

(57) ABSTRACT

A grout float, including a blade and a pair of core sections defining a handle. Interlocking male tapered bosses and female tapered receptacles join the core sections. Tapered tongues on the core sections pass through openings in upstanding flanges on the blade. The tapered tongues produce a wedging action with the flange openings whereby the locking union of the core sections also secures the handle rigidly to the blade. For comfort, the assembled handle and blade are encapsulated in an overmolded elastomeric liquid-tight sheath.

19 Claims, 4 Drawing Sheets

4
13a
13b
11
12
10
4
14

17
64
16
13b
13a
21
65

GROUT FLOAT ASSEMBLY

BACKGROUND OF THE INVENTION

1. Field of the Invention

The subject invention relates to grout floats and more particularly to constructions for grout floats. Still more particularly, it is concerned with methods and means for mounting a handle to a grout float blade whereby the handle or the entire float can be overmolded with a resilient layer of elastomeric material.

2. Prior Art

Grout floats are used in the spreading and removal of excess water from grout prior to the application of tiles to walls, floors and other surfaces. Grout floats are well known in the art and generally take the form of a flat rectangular blade member of metal, plastic or composite material with a handle mounted to its upper surface. The smooth bottom of the tool may be the exposed underside of the blade, a layer of suitable material applied or affixed to the blade, or a laminate formed, for example, of resilient layers of plastic, composite, rubber, sponge, or other well known materials, bonded to the blade.

The early prior art grout float handles were of wood or other convenient material. Cantilevered on a single metal shank, or provided with metal mounting flanges at their ends, these handles were conventionally mounted to the float blade by welding or riveting. Typically, the blades of these tools were susceptible to bending under downward or lateral force. Repeated flexing quickly led to fracturing of the weld or loosening of the rivets and eventual separation of the handle from the blade. Employing heavy construction to minimize or eliminate the problem of flexion increased the weight and production cost of the tool.

Additionally, tools made of exposed metal or employing unprotected metal mounting components were especially susceptible to wear and resulting damage through abrasion or corrosion. Attempts were made to reduce the float's exposure or susceptibility to wear and deterioration by employing assemblies with interlocking components. Few of these were successful, and those generally required multi-step manufacturing operations that proved to be prohibitively expensive.

Present grout floats often use injection moldable plastics, such as glass-filled nylons or polyolefins for the handle. However, when hollow molded plastic handles are used, watertight seals must be maintained around the joints in the component plastic parts. In use, the tool is repeatedly subjected to immersion in highly abrasive slurries and submerged in water for cleaning. If liquid leaks into the handle's hollow cavities, the life of the tool and the weight advantage of a hollow structure are reduced significantly. To achieve the tolerances necessary for proper handle assembly with watertight seals, the manufacturing processes become complex and expensive.

Fabricated handles incorporating combinations of the foregoing constructions for hand tools are well known. Typically, U.S. Pat. No. 5,615,445 by C. Kelsay and A. Ness shows a handle assembly having a protruding ridge on one section that is received by a recessed grove on the opposite section. This groove and ridge combination improves the fit between the two core sections and promotes a watertight seal. The '445 patent illustrates the use of posts and tubes for guiding the member sections into proper alignment; however, it relies on means, such as screws to lock the handle sections together. When these become loose through normal use, the integrity of the entire assembly is compromised.

With extended use, handles of wood, metal, or rigid synthetic materials tend to become uncomfortable to the user's hand, arm and shoulder. Over time, contact of the skin with the grout-covered unyielding handle surface causes painful abrasions, blisters, and eventually, open wounds. It is now common practice to provide tool handles with a soft outer layer for comfort and protection. Typically, the tool handle is formed with a hard core made up of one or more components. In manufacture, the core is rigidly attached to the blade and then placed in a mold and overmolded with a resilient coating, usually of a thermoplastic elastomer. In some instances, both the handle core and the blade are overmolded so as to provide the tool with a unitary resilient outer layer.

Such handle cores can be attached to their blades by a variety of methods. In the 4,724,572 patent, by way of example, the blade is provided with an opening in which the handle is retained by tangs. This requires a special cooperative structure between the handle and blade with material and shaping limitations and the prospect of ultimate loosening resulting from wear and bending of the tangs. In most cases, once the core elements begin to separate or the handle and blade become loose, the overmolding prevents the tool from being repaired.

No known prior art grout float provides a method and cooperative means for both forming a handle core suitable for overmolding and securing the handle to the blade, much less for doing so in a single action. The subject invention serves all of those functions.

SUMMARY OF THE INVENTION

As will be demonstrated, the novel construction of the invention allows the handle core and blade components to be assembled and permanently securely joined in a single motion without the use of welds, rivets, screws or adhesives. The ease of the process and the elimination of need for any additional labor, tools or hardware to complete the assembly of the handle core and the blade provide clear advantages over prior grout float constructions.

The present invention affords significant practical advantages and ergonomic improvements over the art by providing a lightweight handle core rigidly mounted to a blade that can be fully or partially overmolded for the user's comfort and to prevent the penetration of water into the core interior.

It is an object of the invention to provide a construction whereby the two component core sections defining the handle core are securely locked together and the core is permanently rigidly attached to the blade in a single self-locking motion. The locking of the handle core sections is achieved by means of interlocking detents, preferably mating pairs of bosses and receptacles, associated with the handle core sections. Securing of the handle core to the blade is accomplished by the interaction of connectors, preferably a pair of tongues formed on the handle core sections, and one or more retainers, preferably one or more flanges, formed on the blade.

In its preferred form, the grout float assembly includes a blade having an upper surface. An upstanding flange is provided on the upper surface. The flange has an opening adapted for receiving and frictionally interlocking with a pair of tongues. The handle core is made in two sections that are adapted to be assembled into a single unit. The ends of the unit are configured to abut and conform closely with the upper surface of the blade.

The core sections are provided with confronting, interlocking bosses and receptacles. The bosses and receptacles are axially aligned and tapered. Cooperating detents such as annular rings on the bosses and annular grooves in the receptacles interlock securely when the bosses and receptacles are mutually engaged and the handle core sections are forced together. The core sections also have confronting tongues positioned to pass through and frictionally engage the opening in the blade flange and thereby secure the handle to the blade when the boss and receptacle are interlocked.

The tapered tongues produce a wedging action when inserted through the flange openings whereby the locking union of the complete assembly is enhanced and strengthened. The wedging action includes two wedging forces. The first of these is produced when the tapered tongue on each core section slides frictionally against the upper and lower edge of the flange opening. The effect of this action is to draw the ends of the handle core into close, rigid contact with the upper surface of the blade. The second results when the tapered faces of the opposing tongues frictionally engaged each other as the core sections are brought into their final interlocked position. During the assembly motion, the tapered tongues and flange openings position assist the bosses and receptacles in positioning and guiding the core sections and blade into proper alignment.

In lieu of the aforementioned annular rings and grooves, a strong and secure attachment between the component sections of the handle core can be achieved by providing alternative interactive detents on the respective core components. Among various configurations, these can be in the form of cooperating axial vanes and grooves formed on bosses and receptacles associated with the core sections (not shown). Alternatively, the detents can be cooperatively positioned raised and depressed features formed on the core sections for interengagement when the sections are joined. Advantageously, the natural resilience of the plastic material chosen for the handle core sections allows various detent structures to be used. The tapers and drafts can readily be adapted to allow the interlocking bosses, receptacles, tongues and flange options to receive and retain one another. If desired, short locator pins can be provided to assist further in guiding the core sections' tongues and flanges into proper alignment.

It is another object of the invention to overcome the weight disadvantages and other deficiencies of the prior grout floats that make use of solid plastics, metal, wood or other handle materials or which make use of hollow materials with expensive or ineffective component part seals.

As previously mentioned, the construction of the subject invention is especially suited to the application of a resilient overmolded covering to the handle alone or to the entire tool. In one preferred embodiment, the handle core sections forming the ergonomically shaped handle core are molded from a hard, durable plastic material that provides strength and rigidity to the tool once the handle core is secured to the blade. The outer layer overlying the handle core is molded from a relatively soft, resilient material that provides a comfortable, durable, attractive grip. To enhance the effectiveness of the overmolding process, channels are provided adjacent the ends of the handle core to allow the overmolded material to flow into the hollow handle core thereby forming a fluid-tight seal between the periphery of the handle core and the upper surface of the blade and enclosing and further securing the connection between the tongues on the handle core sections and the flanges on the blade.

A specific object of the present invention is to provide an apparatus of the above described characteristics and advantages wherein once assembled the handle core and blade perform as a rigid unitary piece. A further object is to provide a method and means for producing a unitary assembly of the type described which lends itself to overmolding with a resilient material for comfort, durability, and attractive appearance.

For a fuller understanding of the invention and its applications, reference is made to the following detailed description of the preferred embodiments and features illustrated in the accompanying drawings.

BRIEF DESCRIPTION OF THE DRAWINGS

In the drawings wherever practicable the same numeral is used to designate the same or equivalent features. Referring to the figures.

DESCRIPTION OF THE PREFERRED EMBODIMENT

Referring to FIGS. 1–4, the grout float 11 is an assembly made up of a handle core 12 and a blade 19. The handle core 12, and if desired, the blade 19, or at least its upper surface, may be enclosed in a layer of resilient material 14 the details of which are described below.

Figure 1:
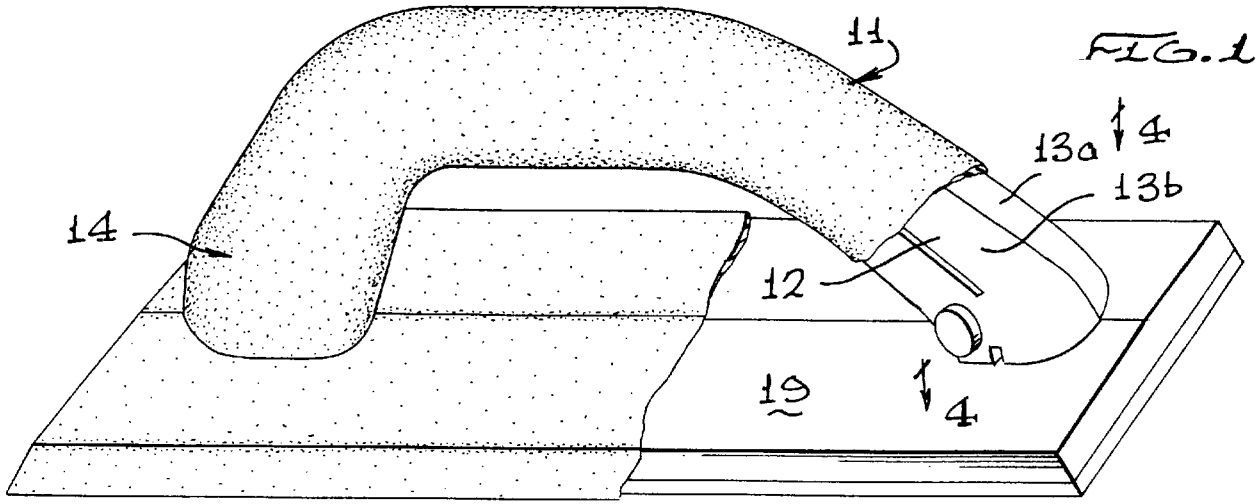
FIG. 1 is a top perspective view of a typical grout float embodying the construction of the subject invention with a portion of the overmolded outer layer cut away to show the internal construction comprising the core sections and blade.

The handle core 12 is comprised of a right section 13*a* and a left section 13*b* (the terms "right" and "left" being determined by the orientation of the float, the end of the float to the viewer's left in FIG. 1 arbitrarily being designated the "front" of the tool). Sections 13*a* and 13*b* and blade 19 are securely rigidly mated through two complimentary locking mechanisms. The first locking mechanism utilizes bosses 30 and receptacles 31. The second locking means employs a tongue 17 and flange 21 arrangement. The flanges 21 at each end of the blade 19 have two apertures 18 that accept the tongues 16, 17 of the core sections 13*a*, 13*b*.

Figure 4:
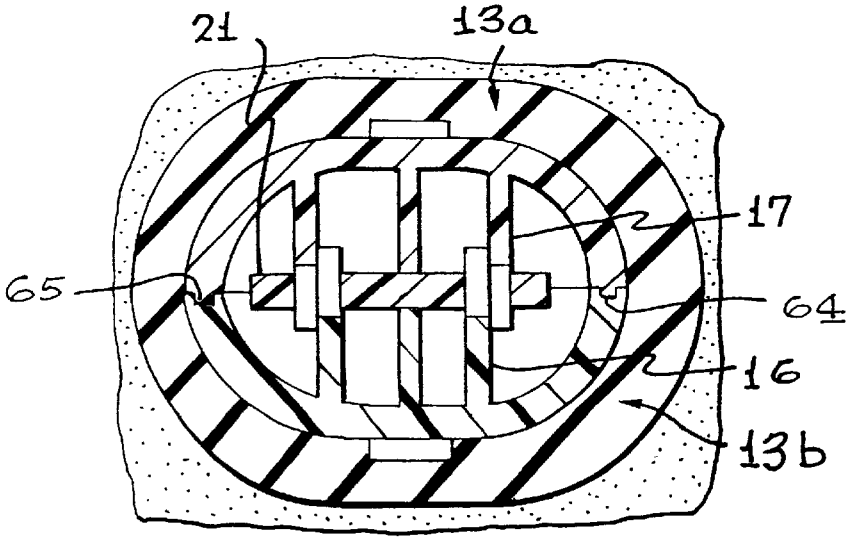
FIG. 4 is a cutaway top sectional view of the tongue and flange interlock arrangement of FIG. 3.
Figure 2:
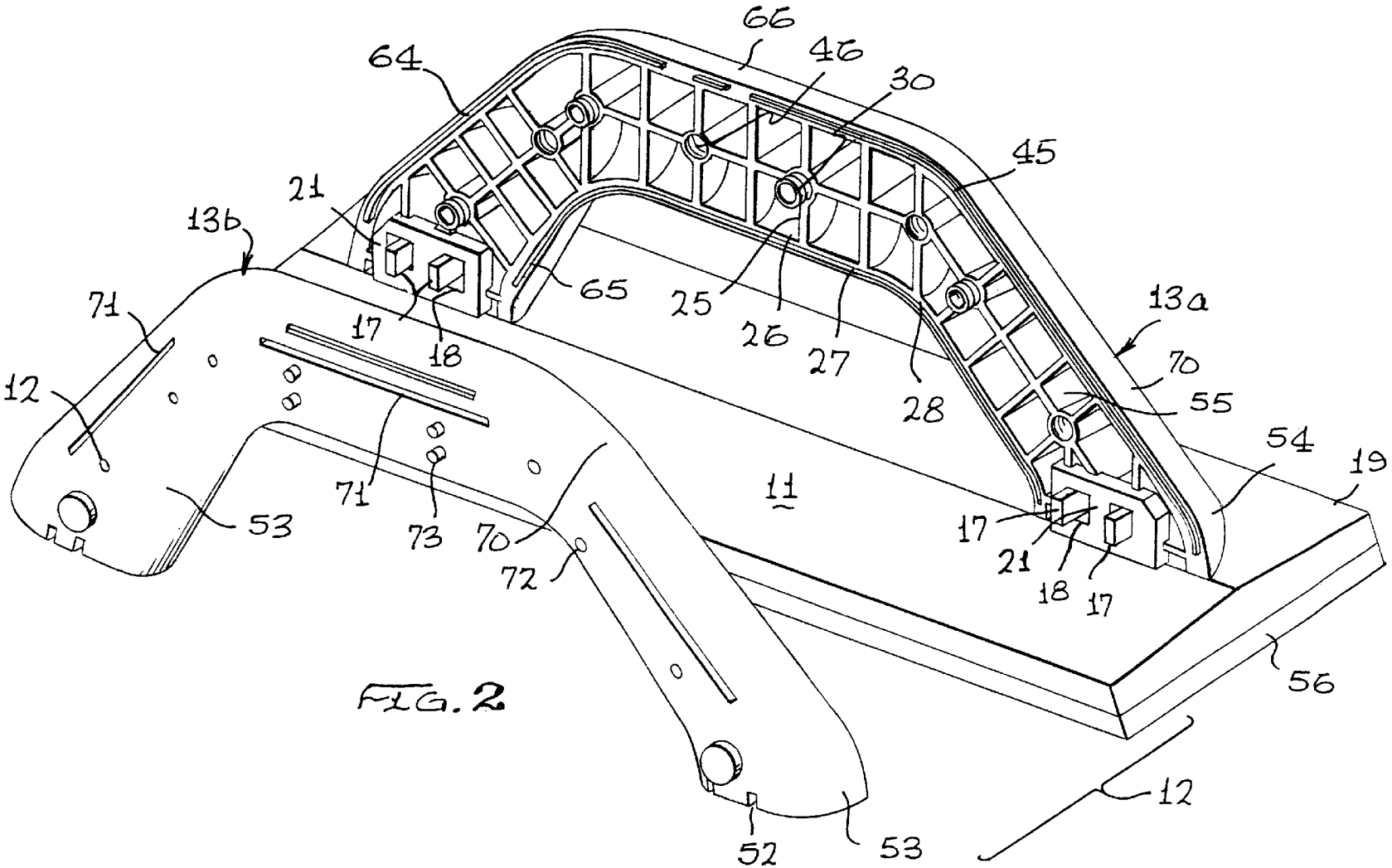
FIG. 2 is an exploded top perspective view of the core sections and blade of the grout float of FIG. 1.

Referring specifically to FIG. 4, the front right core section tongues 17 pass through the blade flange 21 and firmly abut the sides of opposing front left core section tongue 16 sides. Front right core section tongues 17 are on the outside of front left core section tongues 16. Similarly, rear right core section tongues 17 pass through the apertures 18 of the blade flange 21 and firmly abut opposing left right core section tongues 16, but at this end the right core section tongues 17 are on the inside of left core section tongues 16.

Preferably, the tongues 16, 17 are tapered both in height and in thickness. The former taper allows for easier insertion of the tongues into the flange apertures 18. The latter provides a wedging action between the tongues 16, 17 and the flange apertures 18 that enhances the strength and rigidity of the completed assembly 11.

Figure 3:
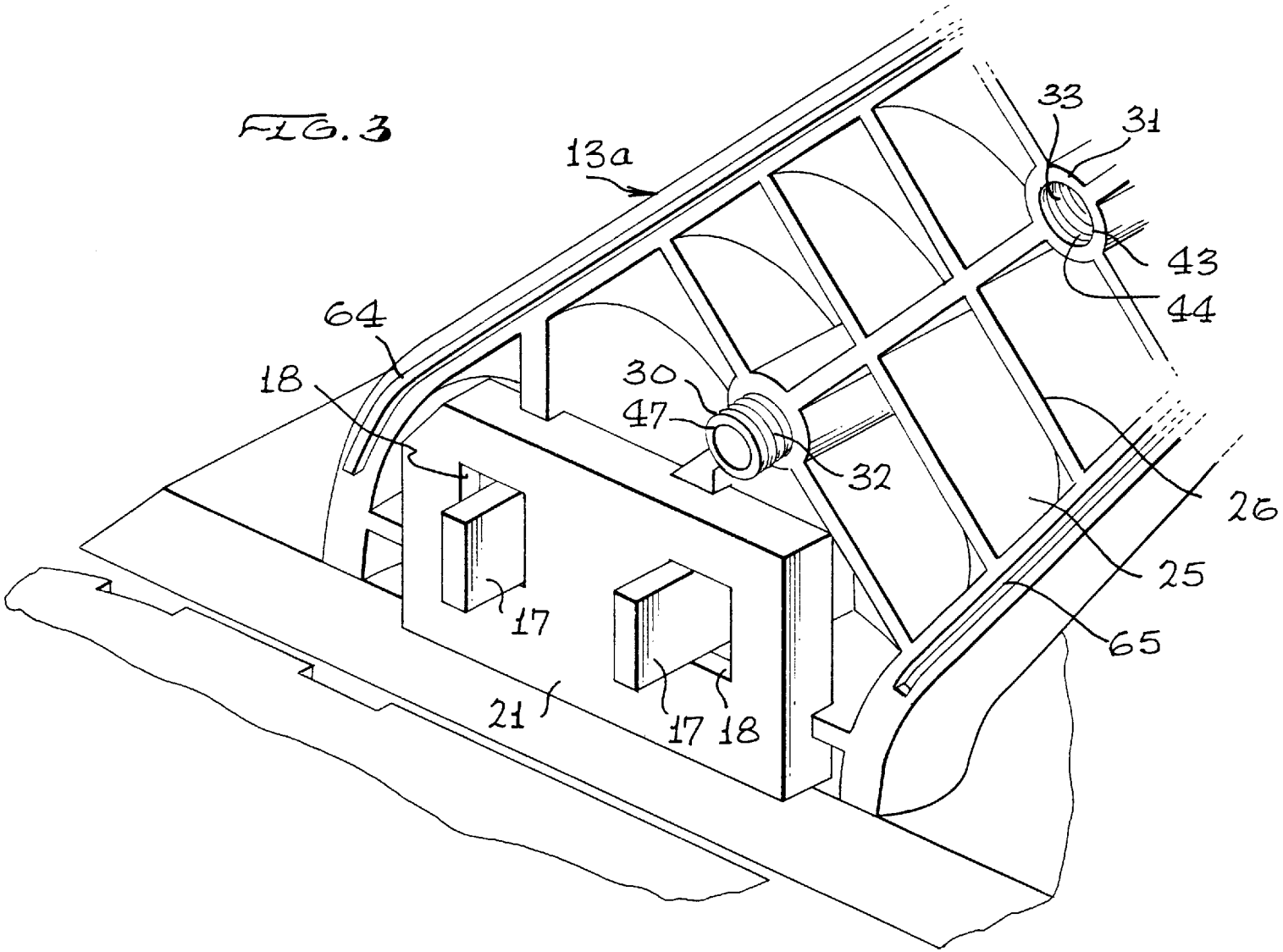
FIG. 3 is an enlarged side perspective view of the grout float as seen in FIG. 2 showing the construction and interaction of the interlocking tongues and flanges and the standing male bosses and their corresponding female receptacles.

Referring specifically to FIG. 3, protruding male bosses 30 and recessed female receptacles 31 are located at intermittent intersections of the walls 26 of the webbed structure 25. Preferably, male bosses 30 and female receptacles 31, have reciprocal tapers that facilitate the location and positioning of the core components. Tapers of about 1½ degrees have been found adequate for these purposes, but the specific taper may be somewhat greater or less, depending on the characteristics of the materials used for the core members.

The surface of each protruding male boss 30 is provided with a raised annular ring 32, or a plurality of axially spaced such rings. The walls of the confronting female receptacles 31 in the other handle section are corresponding provided with detents in the form of one or a plurality of annular grooves 33. Where more than a single ring 32 and groove 33 are employed, the resiliency of the core material allows rings 32 of the male bosses 30 and grooves 33 of the receptacles 31 to flex sufficiently for the rings 32 to override the grooves allowing the bosses 30 and receptacles 31 to engage one another fully and lock together. The mating and interlocking of the opposing male bosses 30 and female receptacles 31 permanently bind the two sections 13*a*, 13*b* into a rigid unitary core 12.

Although shown as circular in cross section, i.e., cylindrical, here, it will be appreciated that the male bosses 30 and corresponding female receptacles 31 may be of any functional configuration including, by way of example but not limitation, square, triangular, or other regular or irregular shape.

When the female receptacle 31 is deeper than the length of the corresponding male boss 30, a raised ring 43 may be added to the female receptacle 31 to form a ridge or shoulder 44 upon which the leading edge 47 of the male boss 30 rests when the male boss 30 is completely inserted into the female receptacle 31.

Referring again to FIGS. 1–4, the interior of the handle core 12 of the preferred embodiment takes the form of a sturdy, rigid, lightweight, webbed injection molded structure 25. Other suitable equivalent constructions and materials can be employed as desired.

Locator pins 45 and locator receptacles 46 are positioned near the top 66 of the handle core 12 to guide the core sections 13*a*, 13*b* into the proper alignment. The locator pins 45 are shorter than the bosses 30.

As pointed out earlier, the novel construction of the subject invention is particularly well suited to overmolding with a layer of resilient material. For convenience in production and overall practical utility, a thermoplastic material, such as Sunprene®, a product manufactured by A. Schulman Company and Mitsubishi Chemical MKV, has proven to be highly advantageous. Sunprene® is a family of recyclable PVC-based thermoplastic elastomers developed as an alternative to thermoset rubber and other thermoplastic elastomers. Sunprene® possesses many rubberlike qualities while offering thermoplastic processing material having a slight soft, non-slip, rubber-like surface that provides a favorable grip to the handle and added ergonomic comfort for the user. In addition to being comfortable, overmolding greatly reduces fatigue of the user's fingers, hand and arm.

An exterior layer 14 can be molded over the handle core 12 only or over the entire device 11 including the handle core 12 and the attached blade 19. The overmolded layer 14 can cover the entire blade 19, top, bottom and edges, or only the blade's upper surface. In the latter case, the bottom surface can be exposed or laminated with a desired surface material 56. The handle core 12 is formed with open channels 52 at the ends 53 where the core interfaces 54 meet the surface of blade 19. The overmolded material 14 flows into the interior 55 of the core 12, forming a watertight seal between the core interface 54 and the blade surface and surrounding the interlocked tongue 17 and flange 18, thereby further strengthening the interlocked tool assembly.

One of the handle core sections 13*a* or 13*b* includes edge ridges 64 and said opposite core section 13*b* or 13*a* includes corresponding grooves 65 that guide the core sections 13*a*, 13*b* into proper alignment and enhance the watertight seal of the completed assembly. A core section may contain both ridges 64 or grooves 65 at various points along its edge with opposing core section having the opposite mating surface.

Conventionally, the exterior 70 of the handle core 12 is formed with elongated grooves 71, indentations 72, bosses 73 or other suitable surface treatments, effects or textures to maximize the frictional contact between the surface of core 12 and the encapsulating overmolded material 14. The purpose of this arrangement is to prevent slippage of the overmolded layer 14 on the handle core 12 during usage; Additionally, the overmolded layer 14 serves to further insure the integrity of the handle core and blade assembly.

In the preferred embodiment the handle core 12 is generally bilaterally symmetrical in section. The top portion 66 is flattened or otherwise conformed to provide ergonomic fit to the user's hand. While axial symmetry of the handle core 12 allows either end 53 to be oriented as the front or rear of the handle, it may be advantageous, and the invention is adaptable, to conform the handle with asymmetrical ends, or to design a grout float with the handle cantilevered from one end, that end being mounted to the blade by means of tongues and a flange in precisely the manner previously described in connection with each of the ends of the embodiment depicted in the drawing, neither of these embodiments being shown. The use of a tongue 16, 17 and flange 18 arrangement for attaching the blade 19 to the handle 12 allows a single handle core 12 to be used with blades 19 of various sizes and shapes.

While not shown in the drawings, the retaining means associated with the bosses and receptacles may take a variety of alternative forms. By way of example and not limitation, rather than the interlocking annular rings and grooves 32, 33, they may be a radial vane or vanes formed on the bosses and a corresponding radial groove or grooves extending axially in the walls of the receptacles.

Figure 5:
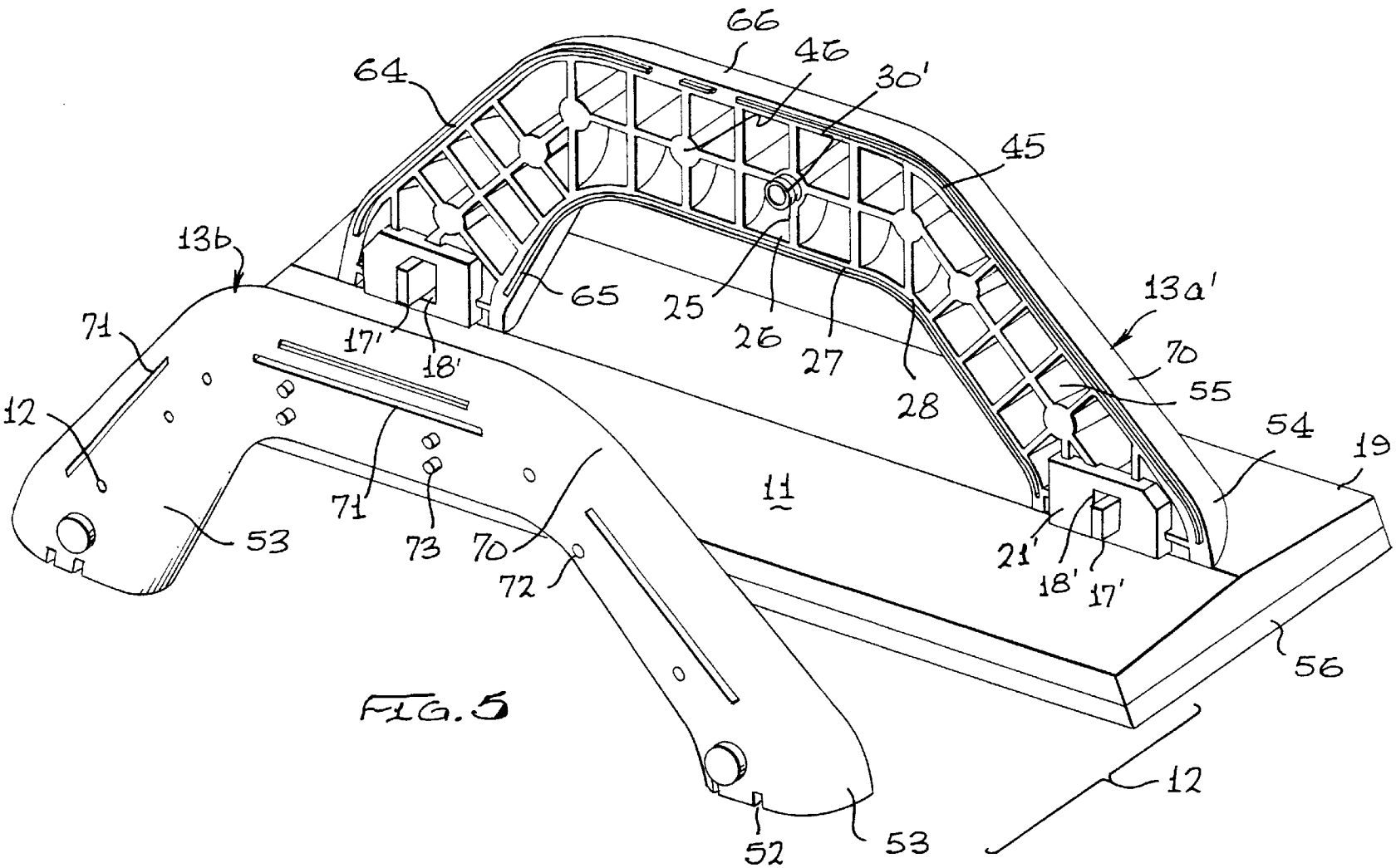
FIG. 5 is an exploded top perspective view similar to the view of FIG. 2, showing the core sections and blade of another embodiment of the invention.

FIGS. 1–4 illustrate an embodiment of the invention comprising pairs of openings 18 in each of the flanges 21, pairs of tongues 16, 17 associated with each opening 18, and a plurality of interlocking bosses 30 and receptacles 31. FIG. 5 illustrates an embodiment in which the flange 21' has a single opening 18' adapted to receive an associated single pair of tongues 16', 17', and the core sections 13*a*', 13*b*' are retained by a single boss 30' and mating receptacle 31' (not visible). It will be understood by one skilled in the art that the invention may be constructed with one or a plurality of openings in the respective flanges and with one or a plurality of tongues on the respective core sections, and with one boss and interlocking receptacle or a plurality of bosses and receptacles.

From the foregoing description, the advantages afforded by the novel features of the subject invention will be readily apparent. It should be understood, however, that while the invention has been described in terms of the constructions shown in the drawings and certain exemplary modifications thereof, it is not to be construed as limited to those embodiments. They are to be regarded as illustrative rather than restrictive. The invention encompasses any and all variations of the examples chosen for the purposes of disclosure, which do not depart from the spirit, intent and scope of the following claims.

What is claimed is:

1. A grout float assembly, comprising:

a blade, said blade having a top surface, the top surface having a flange upstanding thereupon, the flange having an opening therein;

a handle core comprising two sections, the sections having a mating boss and receptacle, respectively, and each section having a tongue, the tongues engaging the opening in the flange and thereby securing the handle core to said blade when the boss and receptacle are in mated relationship; and detent means for retaining the boss in the receptacle.

2. The grout float of claim 1, wherein the boss and the receptacle are tapered for frictional retention.

3. The grout float of claim 1, wherein the boss and the receptacle include cooperating retaining means for retaining the boss in the receptacle.

4. The grout float of claim 3, wherein the boss includes an outer surface having a raised portion and the receptacle includes a wall having a recessed portion corresponding to the raised portion on the surface of the boss for receiving and retaining the raised portion on the surface of the boss.

5. The grout float of claim 4, wherein the raised portion of the boss defines an annular ring and the recessed portion of the receptacle defines an annular groove.

6. The grout float of claim 5, wherein:

said handle core includes at least one end portion that conforms to the top surface of said blade; and the tongues are tapered, whereby their engagement with the opening in the flange urges the conforming end portion of said handle core into rigid abutment with the top surface of said blade.

7. The grout float of claim 1, wherein said handle core is enclosed in an overcoating of elastomeric material.

8. The grout float of claim 7, wherein:

the conforming end portion of said handle core contains an open-ended cavity and a channel in communication with the cavity whereby liquid thermoplastic material under pressure entering the channel is injected into the cavity providing a seal between the confronting end portion of said handle core and the top surface of said blade.

9. The grout float of claim 1, wherein said handle core and the top surface of said blade are enclosed in a unitary overcoating of elastomeric material.

10. The grout float of claim 1, wherein the boss and receptacle are generally cylindrical in shape.

11. A grout float, comprising:

a blade, said blade having a top surface, the top surface having a flange upstanding thereupon, the flange having an opening therein;

a handle core comprising two sections, the sections having an interlocking male boss and corresponding female receptacle, respectively, the male boss and female receptacle engaging one another in secure, rigid interlocking relationship when the sections are brought together forcefully;

a tapered tongue on each of the handle core sections, said tongues engaging the opening in the flange and thereby urging said handle core into rigid abutment with, and securing said handle core rigidly to, said blade when the boss and receptacle are in interlocking relationship.

12. The grout float of claim 11, wherein said handle core is enclosed in an overcoating of elastomeric material.

13. The grout float of claim 11, wherein said handle core and the top surface of said blade are enclosed in an overcoating of elastomeric material.

14. A method for assembling a grout float, comprising:

providing a blade, said blade having a top surface, the top surface having a flange upstanding thereupon, the flange having an opening therein;

providing a handle core comprising two sections, the sections having an interlocking male boss and corresponding female receptacle, respectively, the boss having an outer surface bearing a raised portion thereon and the receptacle having an internal surface containing a recess therein, the raised portion rigidly securely engaging the recess when the two handle core sections are brought together forcefullly; and providing a tapered tongue on each of the core sections, the tongues overlapping one another and engaging the opening in the flange and thereby urging said handle core into rigid abutment with, and rigidly securing said handle core to, the top surface of said blade when the raised portion on the boss surface and the recess in the internal surface of the receptacle are in engagement.

15. The method of claim 14, comprising enclosing said handle core in an overcoating of elastomeric material.

16. The method of claim 14, comprising enclosing said handle core and the top surface of said blade in a unitary overcoating of elastomeric material.

17. A grout float assembled by means of the method of claim 14.

18. A grout float assembled by means of the method of claim 15.

19. A grout float assembled by means of the method of claim 16.

* * * * *